US011927186B2

(12) United States Patent
Choi et al.

(10) Patent No.: US 11,927,186 B2
(45) Date of Patent: Mar. 12, 2024

(54) SCROLL COMPRESSOR

(71) Applicant: LG Electronics Inc., Seoul (KR)

(72) Inventors: Yoonsung Choi, Seoul (KR); Sangbaek Park, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/150,002

(22) Filed: Jan. 4, 2023

(65) Prior Publication Data

US 2023/0358230 A1 Nov. 9, 2023

(30) Foreign Application Priority Data

May 4, 2022 (KR) ..... 10-2022-0055511

(51) Int. Cl.

| | |
|---|---|
| ***F04C 18/02*** | (2006.01) |
| ***F04C 2/02*** | (2006.01) |
| ***F04C 15/06*** | (2006.01) |
| ***F04C 23/00*** | (2006.01) |

(52) U.S. Cl.

CPC ..... *F04C 15/06* (2013.01); *F04C 2/025* (2013.01); *F04C 18/0269* (2013.01); *F04C 18/0292* (2013.01); *F04C 2210/26* (2013.01); *F04C 2250/101* (2013.01); *F04C 2250/20* (2013.01); *F04C 2250/30* (2013.01)

(58) Field of Classification Search

CPC ..... F04C 15/06; F04C 2/025; F04C 18/0246; F04C 18/0269; F04C 18/0292

See application file for complete search history.

(56) References Cited

U.S. PATENT DOCUMENTS

| | | | |
|---|---|---|---|
| 4,781,549 | A | 11/1988 | Caillat |
| 5,249,943 | A | 10/1993 | Kuroki et al. |
| 5,370,512 | A | 12/1994 | Fujitani et al. |
| 10,619,635 | B2 | 4/2020 | Branch et al. |

(Continued)

FOREIGN PATENT DOCUMENTS

| | | | | |
|---|---|---|---|---|
| GB | 2397346 A | * | 7/2004 | ..... F04C 18/0269 |
| JP | S6-1104183 | | 5/1986 | |
| JP | H01-130083 | | 5/1989 | |

(Continued)

OTHER PUBLICATIONS

English WO-2013021545 by PE2E Apr. 14, 2023.*

(Continued)

*Primary Examiner* — Deming Wan
(74) *Attorney, Agent, or Firm* — Fish & Richardson P.C.

(57) ABSTRACT

Provided is a scroll compressor. The scroll compressor may be provided with at least one refrigerant accommodating groove recessed to a preset depth in at least one from a side surface of a fixed wrap constituting a compression chamber and a side surface of an orbiting wrap. Thus, a volume of the compression chamber in a discharge area may be increased in correspondence with a volume of the at least one refrigerant accommodating groove, and a space into which liquid refrigerant, etc. may escape may be ensured to resolve excessive compression in the compression chamber. Then, a stress exerted on the fixed wrap is reduced, and a damage to the fixed wrap due to pressure in the compression chamber may be suppressed.

19 Claims, 11 Drawing Sheets

(56) References Cited

U.S. PATENT DOCUMENTS

| | | | | |
|---|---|---|---|---|
| 2007/0036668 | A1* | 2/2007 | Lifson | F04C 29/12 418/55.1 |
| 2019/0010945 | A1 | 1/2019 | Choi et al. | |

FOREIGN PATENT DOCUMENTS

| | | | | |
|---|---|---|---|---|
| JP | H06-147147 | | 5/1994 | |
| JP | H07-35791 | | 4/1995 | |
| KR | 10-2017-0122020 | | 11/2017 | |
| KR | 10-2019-0006400 | | 1/2019 | |
| KR | 10-2019-0135375 | | 12/2019 | |
| WO | WO-2013021545 | A1 * | 2/2013 | F04C 18/0215 |

OTHER PUBLICATIONS

GB 2397346 by PE2E, Oct. 10, 2023.*
Extended European Search Report in European Appln. No. 22217270.2, dated Oct. 2, 2023, 13 pages.
Office Action in Korean Appln. No. 10-2022-0055511, dated Aug. 1, 2023, 10 pages (with English translation).

* cited by examiner

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2022-0055511, filed on May 4, 2022, the contents of which are incorporated by reference herein in their entirety.

TECHNICAL FIELD

The disclosure relates to a scroll compressor, and more particularly, a scroll compressor having an enlarged discharge area.

BACKGROUND

A compressor applied to a refrigeration cycle of a refrigerator, an air handling unit, etc. performs a function of compressing and transmitting refrigerant gas to a condenser. A rotary compressor or a scroll compressor is applied to the air handling unit. The scroll compressor is not only applied to the air handling unit, but also recently applied to a water heater that requires a higher compression ratio than the air handling unit.

The scroll compressor may be classified into a hermetic scroll compressor in which a driving unit (or a motor part) and a compression unit are included together in a casing, and an open-type scroll compressor in which a driving unit (or a motor part) is included outside a casing and only a compression unit is included in the casing.

The scroll compressor may be classified into a top compression type scroll compressor and a bottom compression type scroll compressor according to locations of a driving motor, constituting a driving unit or a motor part, and a compression unit. The top compression type scroll compressor is a compressor type in which a compressor is located above a driving motor, and the bottom compression type scroll compressor is a compressor type in which a compression unit is located below a driving motor. This classification is based on an example in which a casing is installed as a vertical type or a standing type. When a casing is installed as a horizontal type, a left side may be classified as an upper side and a right side may be classified as a lower side for convenience.

The scroll compressor may be respectively classified into a low-pressure type scroll compressor in which an inner space of a casing including a compression unit provides suction pressure and a high-pressure type scroll compressor providing discharge pressure. The top compression type scroll compressor may be configured as a low-pressure type or a high-pressure type. However, the bottom compression type scroll compressor is generally configured as a high-pressure type scroll compressor in consideration of a position of a refrigerant suction pipe.

The scroll compressor includes a fixed scroll including a fixed wrap and an orbiting wrap engaged with the fixed wrap. In the scroll compressor, the orbiting scroll performs an orbiting motion on the fixed scroll.

As the orbiting scroll perform the orbiting motion, the scroll compressor is provided with a first compression chamber between an inner surface of the fixed wrap and an outer surface of the orbiting wrap, and a second compression chamber between an outer surface of the fixed wrap and an inner surface of the orbiting wrap. In the first and second compression chambers, a volume change occurs sequentially according to the orbiting motion of the orbiting scroll to perform suction and compression of refrigerant.

Characteristics of the scroll compressor is determined by shapes of the fixed wrap and the orbiting wrap. The fixed wrap and the orbiting wrap may have any shapes, but generally have a form of an involute curve which is easily machined. Recently, a scroll compressor provided in a form in which a plurality of circular arcs having different diameters and origins are connected to each other so that wrap curves of a fixed wrap and an orbiting wrap have atypical characteristics is introduced.

In some examples, a scroll compressor has the atypical wrap curve described above. The scroll compressor is provided such that an eccentric portion of a rotating shaft is coupled to an orbiting scroll on a same plane as that of an orbiting wrap (in an overlapping position on the rotating shaft). This may be generally defined as a through-shaft scroll compressor.

In this through-shaft scroll compressor, a point of action at which repulsive force of refrigerant works and a point of action at which a reaction force against the repulsive force works are located at a same height such that the repulsive force and the reaction force work in opposite directions. Thus, a problem such that the orbiting scroll is inclined may be resolved.

However, with respect to the through-shaft scroll compressor described above, as a rotating shaft is inserted through the fixed scroll, a discharge port is provided in a location eccentric from the fixed scroll. Thus, since compression ratios in compression chambers at both sides become different, an increase portion is provided on the orbiting wrap and a decrease portion corresponding to the increase portion is provided on the fixed wrap. Thus, the compression ratios of the compression chambers at both sides are compensated for to be similar to each other.

However, as the decrease portion is provided near a discharge end of the fixed wrap as described above, the fixed wrap has a small wrap thickness near the discharge end under a comparatively high pressure. Thus, the fixed wrap may not stand pressure in the compression chamber and may be damaged. This may more frequently occur in a compressor that requires a higher compression ratio than that of a compressor applied to an air handling unit, e.g., a compressor for a water heater in which liquid refrigerant or oil excessively flow into a compression chamber.

SUMMARY

Therefore, the present disclosure describes a scroll compressor in which a damage to a discharge end of a fixed wrap may be suppressed.

Further, the present disclosure describes a scroll compressor in which a side surface of a fixed wrap and a side surface of an orbiting wrap are slidably in contact with each other, and a volume of a compression chamber between the fixed wrap and the orbiting wrap may be enlarged.

Still further, the present disclosure describes a scroll compressor in which a side surface of a fixed wrap and a side surface of an orbiting wrap are slidably in contact with each other, and a space into refrigerant may temporarily escape may be ensured between the fixed wrap and the orbiting wrap.

The present disclosure also describes a scroll compressor capable of quickly discharging refrigerant from a compression chamber included in a discharge area.

Further, the present disclosure provides a scroll compressor capable of quickly discharging refrigerant by enlarging a substantial discharge area while maintaining a discharge start time.

Still further, the present disclosure describes a scroll compressor capable of ensuring wrap rigidity of a fixed wrap while enlarging a substantial discharge area.

In order to achieve these and other advantages and in accordance with the purpose of this specification, as embodied and broadly described herein, there is provided a scroll compressor including a fixed scroll and a fixed scroll. The orbiting scroll may be coupled to a rotating shaft and provided with an orbiting wrap at one side of an orbiting end plate to perform an orbiting motion. The fixed scroll may be provided with a fixed wrap on one side surface of a fixed end plate, the fixed wrap being engaged with the orbiting wrap to define a compression chamber. At least one refrigerant accommodating groove recessed to a preset depth may be provided in at least one from a side surface of the fixed wrap constituting the compression chamber, and a side surface of the orbiting wrap. Thus, a volume of the compression chamber in a discharge area may be increased in correspondence with a volume of the at least one refrigerant accommodating groove, and a space into which liquid refrigerant, etc. may escape may be ensured to resolve excessive compression in the compression chamber. Then, a stress exerted on the fixed wrap may be reduced, and a damage to the fixed wrap due to pressure in the compression chamber may be suppressed.

As an example, at least one refrigerant accommodating groove may be provided such that an axial length is greater than a radial depth. Thus, a wrap thickness of the fixed wrap or the orbiting wrap may be properly maintained, and a large volume of the refrigerant accommodating groove may be ensured. Thus, a damage to the fixed wrap or the orbiting wrap due to the refrigerant accommodating groove may be suppressed.

As another example, the axial length of the refrigerant accommodating groove may be provided to be equal to or less than a wrap height of the fixed wrap or the orbiting wrap. Thus, deterioration of rigidity of the fixed wrap or the orbiting wrap due to the refrigerant accommodating groove may be suppressed, and thus, a wrap damage due to the refrigerant accommodating groove may be prevented in advance.

In detail, the axial length of the refrigerant accommodating groove may be provided to be greater than half of the wrap height of the fixed wrap or the orbiting wrap and less than the wrap height. Thus, a wrap thickness of the fixed wrap or the orbiting wrap may be properly maintained, and a large volume of the refrigerant accommodating groove may be ensured.

As another example, the refrigerant accommodating groove may be spaced apart from the fixed end plate or the orbiting end plate by a preset height. Thus, rigidity of a wrap root of the fixed wrap or the orbiting wrap may be ensured. Accordingly, the refrigerant accommodating groove may be provided, and meanwhile a wrap damage in the fixed wrap or the orbiting wrap may be suppressed.

As another example, the fixed wrap may include a decrease portion in which a wrap thickness of the fixed wrap decreases, and a projecting portion extending from the decrease portion to constitute an end of the fixed wrap and having an increased wrap thickness compared to the decrease portion. The refrigerant accommodating groove may be provided in an inner surface of the protruding portion. By doing so, the refrigerant accommodating groove is provided in a discharge area and a volume of the compression chamber corresponding to a discharge area may be increased, and a space into which liquid refrigerant, etc. may escape may be ensured to resolve excessive compression in the compression chamber.

In detail, a radial depth of the refrigerant accommodating groove may be provided to be less than half of the wrap thickness in the projecting portion. Thus, a volume of the compression chamber in the discharge area may be enlarged, a space into which liquid refrigerant, etc. may escape may be ensured, and a wrap thickness of the fixed wrap may be ensured due to the refrigerant accommodating groove to suppress a damage to the fixed wrap.

In addition, a minimum distance from an inner surface of the refrigerant accommodating groove to an outer surface of the projecting portion may be equal to or greater than the wrap thickness in the decrease portion Thus, the refrigerant accommodating groove may be provided and rigidity of the fixed wrap may be properly maintained to suppress a damage.

As another example, with respect to the refrigerant accommodating groove, a plurality of refrigerant accommodating grooves may be provided to have a preset space therebetween along a providing direction of the fixed wrap or the orbiting wrap. Thus, a volume of the refrigerant accommodating groove may be ensured at maximum, and a wrap thickness of the fixed wrap or the orbiting wrap may be properly maintained to suppress deterioration of a wrap strength of the refrigerant accommodating grooves.

As still another example, the fixed end plate may be provided with a discharge port configured to discharge refrigerant compressed in the compression chamber. The refrigerant accommodating groove may be spaced apart from the discharge port. Thus, the refrigerant accommodating groove may be provided, and meanwhile deterioration of a wrap strength of the fixed wrap may be suppressed by maintaining a proper distance between the refrigerant accommodating groove and the discharge port.

As still another example, the fixed end plate may be provided with a discharge port configured to discharge refrigerant compressed in the compression chamber. The refrigerant accommodating groove may be located at a side behind the discharge port along a compression progressing direction in the compression chamber. Thus, the refrigerant accommodating groove may be provided in the compression chamber constituting a substantial discharge area to reduce a shearing stress exerted on the fixed wrap due to a high pressure in the compression chamber.

As still another example, the compression chamber may include a first compression chamber provided in an inner surface of the fixed wrap and a second provided in an outer surface of the fixed wrap. The fixed end plate may be provided with a first discharge port configured to discharge refrigerant in the first compression chamber and a second discharge port configured to discharge refrigerant of the second compression chamber. The refrigerant accommodating groove may be provided between the first discharge port and the second discharge port along a providing direction of the fixed wrap. Thus, a volume of the compression chamber corresponding to a substantial discharge area may be increased and an excessive pressure increase in the compression chamber due to uncompressed liquid refrigerant may be effectively resolved. Accordingly, a damage to the fixed wrap may be suppressed.

As still another example, the compression chamber may include a first compression chamber provided in an inner surface of the fixed wrap and a second provided in an outer surface of the fixed wrap. The fixed end plate may be provided with a first discharge port configured to discharge refrigerant in the first compression chamber and a second discharge port configured to discharge refrigerant of the second compression chamber. An auxiliary discharge port may be provided between the first discharge port and the second discharge port to be inserted through the fixed end plate. Thus, a discharge area of the compression chamber corresponding to a discharge area may be enlarged to reduce a discharge resistance of compressed liquid. Accordingly, excessive compression may be resolved. Simultaneously, the refrigerant accommodated in the refrigerant accommodating groove may be quickly discharged through the auxiliary discharge port to effectively resolve excessive compression.

In detail, an inlet of the auxiliary discharge port may be spaced apart from an inlet of the first discharge port and an inlet of the second discharge port. An outlet of the auxiliary discharge port may communicate with an outlet of the first discharge port, or (an outlet of) the second discharge port. Thus, the refrigerant compressed in the compression chamber may be quickly discharged, and the refrigerant accommodated in the refrigerant accommodating groove may quickly flow out.

In addition, with respect to the auxiliary discharge port, a plurality of auxiliary discharge ports may be provided to have a preset space with each other between the first discharge port and the second discharge port along a providing direction of the fixed wrap. Thus, a discharge area of the compression chamber may be ensured and rigidity of a root portion of the fixed wrap may be ensured to provide the auxiliary discharge ports and suppress a damage to the fixed wrap.

In detail, inlets of the plurality of auxiliary discharge ports may be spaced apart from the first discharge port and the second discharge port, and outlets of the plurality of auxiliary discharge ports may communicate with the first discharge port and/or the second discharge port, and the outlets of the plurality of auxiliary discharge ports may communicate with the first discharge port and the second discharge port in equal numbers, respectively. Thus, discharge areas of compression chambers at both sides may be evenly enlarged, and refrigerant compressed in the compression chambers at both sides may be evenly distributed in the auxiliary discharge ports, and thus, discharged quickly.

In addition, the refrigerant accommodating groove may be spaced apart from the auxiliary discharge port. By doing so, as the refrigerant accommodating groove and the auxiliary discharge ports are separated from each other, the refrigerant accommodating groove and the auxiliary discharge ports are provided together and a wrap strength of the fixed wrap may be ensured.

As still another example, the orbiting wrap may be provided with a discharge guide groove connecting an outer surface constituting the compression chamber to an end surface of the orbiting wrap, the end surface facing the fixed end plate. The refrigerant accommodating groove may communicate with at least a part of the refrigerant accommodating groove in a discharge section of the compression chamber. Accordingly, a substantial discharge area in the compression chamber may be enlarged due to the refrigerant accommodating groove, and the refrigerant accommodated in the refrigerant accommodating groove may quickly flow out.

DETAILED DESCRIPTION

Description will now be given in detail of a scroll compressor disclosed herein, with reference to the accompanying drawings. In the following description, a description of some components may be omitted to clarify features of the present disclosure.

In addition, the term "upper side" used in the following description refers to a direction away from a support surface for supporting a scroll compressor according to an implementation of the present disclosure, that is, a direction toward a driving unit (motor part or driving motor) when viewed based on the driving unit (motor part or driving motor) and a compression part. The term "lower side" refers to a direction toward the support surface, that is, a direction toward the compression part when viewed based on the driving unit (motor part or driving motor) and the compression part.

The term "axial direction" used in the following description refers to a lengthwise (longitudinal) direction of a rotating shaft. The "axial direction" may be understood as an up and down (or vertical) direction. The term "radial direction" refers to a direction that intersects the rotating shaft.

Hereinafter, a hermetic scroll compressor in which a driving unit (or a motor part or a driving motor) and a compression unit are included in a casing is described as an example of the scroll compressor. However, an open-type compressor in which a driving unit (a motor part or a driving motor) is included outside the casing and connected to a compression unit in the casing may be also adopted as the scroll compressor.

In addition, hereinafter, a compressor which is a vertical-type scroll compressor, in which a motor part and a compression unit are arranged in a longitudinal axial direction, and also a bottom compression type scroll compressor, in which a compression unit is located below a driving unit (or a motor part or a driving motor), is described as an example. However, the description may be also applied to not only a horizontal type scroll compressor in which a driving unit (a motor part or a driving motor) and a compression unit are arranged in a left-right direction, but also a top compression type scroll compressor in which a compression unit is arranged above a driving unit (a motor part or a driving motor) are arranged In addition, hereinafter, a bottom compression type and high pressure scroll compressor in which a refrigerant suction pipe constituting a suction passage is directly connected to a compression unit and a refrigerant discharge pipe communicates with an inner space of a casing so that the inner space of the casing provides discharge pressure is described as an example.

Figure 1:
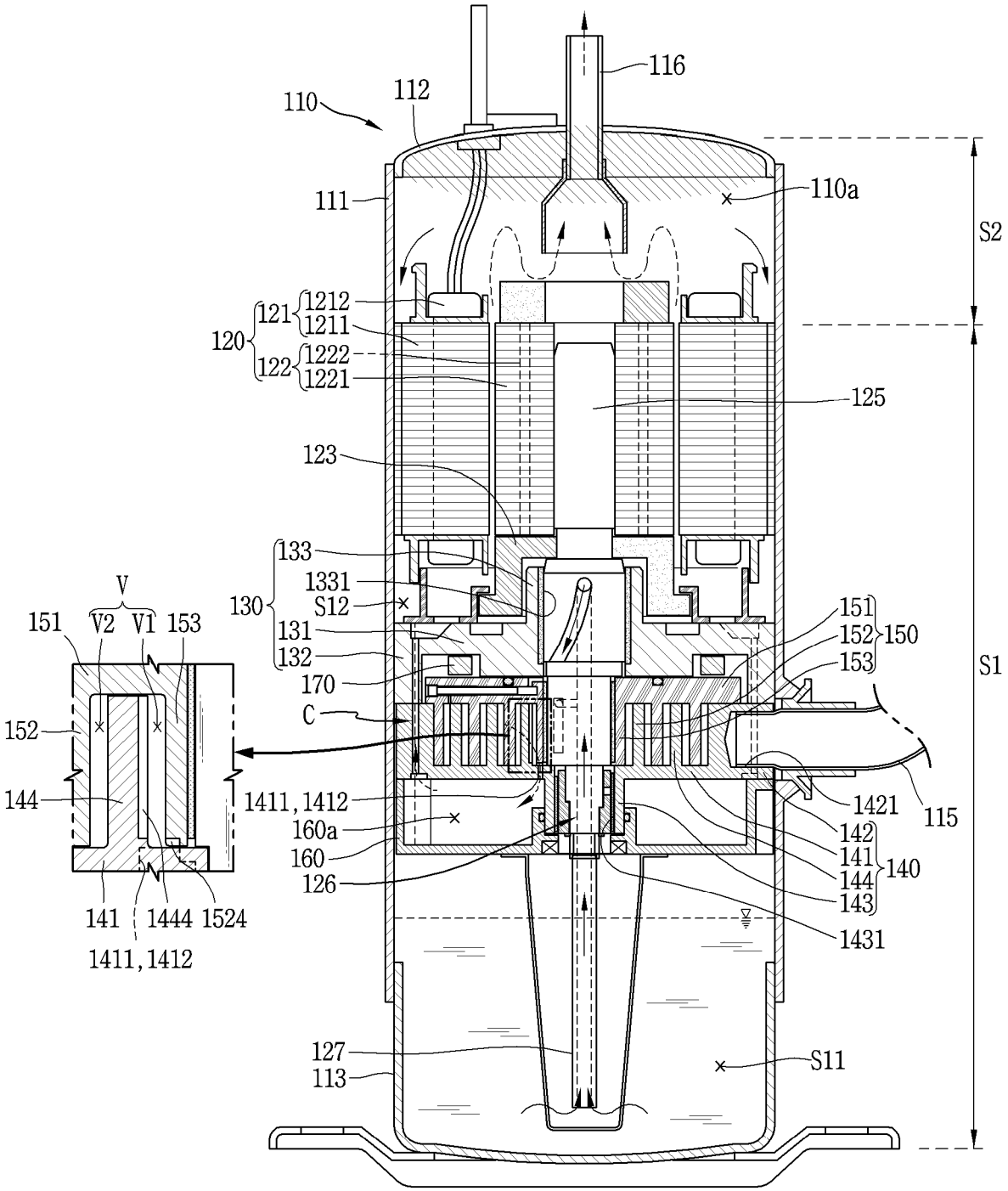
FIG. 1 is a longitudinal sectional view of a bottom-compression type scroll compressor in accordance with this implementation.

FIG. 1 is a longitudinal sectional view illustrating an inner structure of a scroll compressor in accordance with this implementation.

Referring to FIG. 1, a high-pressure and bottom-compression type scroll compressor (hereinafter, referred to as a scroll compressor) according to this implementation includes a driving motor 120 constituting a motor part disposed in an upper portion of a casing 110, and a main frame 130, a fixed scroll 140, an orbiting scroll 150, and a discharge cover 160 disposed below the driving motor 120. In general, the driving motor 120 may constitute the motor part as described above, and the main frame 130, the fixed scroll 140, the orbiting scroll 150, and the discharge cover 160 may constitute a compression part C.

The driving motor 120 constituting the motor part is coupled to an upper end of a rotating shaft 125 to be described later, and the compression part C is coupled to a lower end of the rotating shaft 125. Accordingly, the compressor 10 constitutes the bottom-compression type structure described above, and the compression part C is connected to the driving motor 120 by the rotating shaft 125 to operate according to rotational force of the driving motor 120. Thus, the driving motor 120 may be understood as a driving unit configured to drive the compression unit C. Hereinafter, in the description, a driving motor may be also referred as a motor part or a driving unit.

Figure 2:
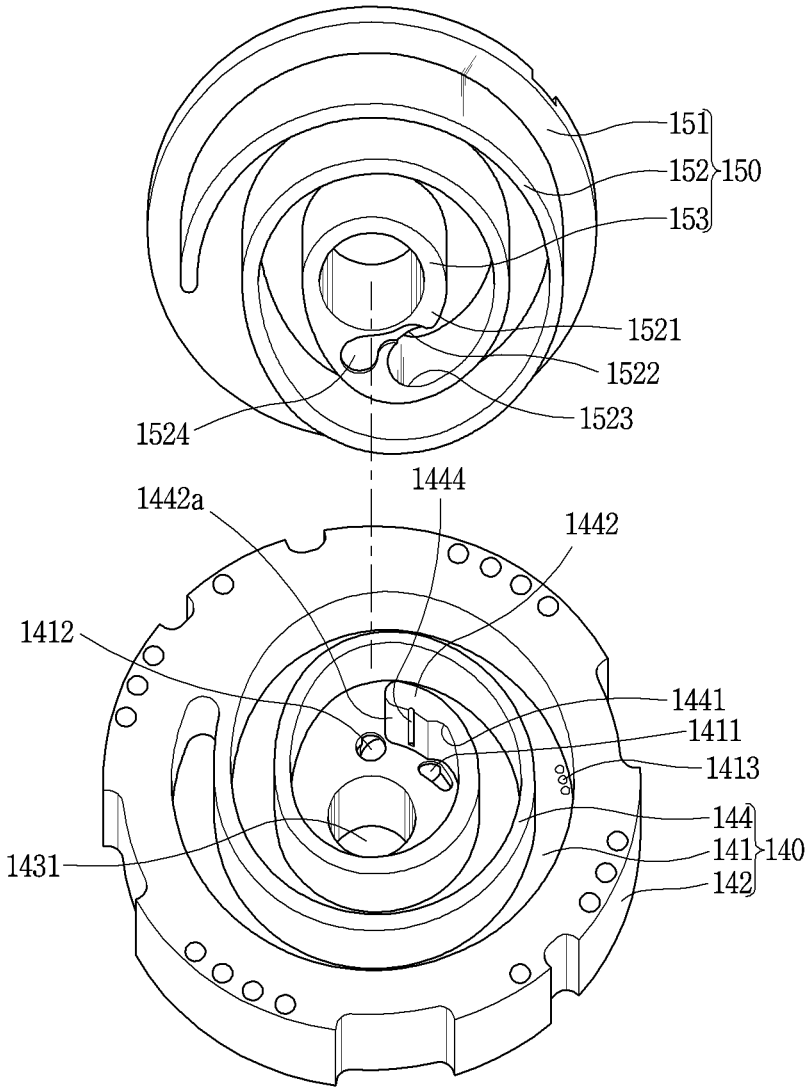
FIG. 2 is a detached perspective view of a fixed scroll and an orbiting scroll both shown in FIG. 1.

Referring to FIG. 2, the casing 110 according to the implementation may include a cylindrical shell 111, an upper shell 112, and a lower shell 113. The cylindrical shell 112 may be formed in a cylindrical shape with upper and lower ends open. The upper shell 112 may be coupled to cover the open upper end of the cylindrical shell 111. The lower shell 113 may be coupled to cover the open lower end of the cylindrical shell 111. Accordingly, the inner space 110*a* of the casing 110 may be sealed. The sealed inner space 110*a* of the casing 110 may be divided into a lower space S1 and an upper space S2 based on the driving motor 120.

The lower space S1 may be a space defined below the driving motor 120. The lower space S1 may be further divided into an oil storage space S11 and a ⊤ outflow passage S12 with the compression part C therebetween.

The upper space S2 may be a space defined above the driving motor 120 to form an oil separating space in which oil is separated from refrigerant discharged from the compression part C. The upper space S2 communicates with refrigerant discharge pipe 116 which will be described later.

The driving motor 120 and the main frame 130 may be fixedly inserted into the cylindrical shell 111. An outer circumferential surface of the driving motor 120 and an outer circumferential surface of the main frame 130 may be respectively provided with an oil return passage (no reference numeral) spaced apart from an inner circumferential surface of the cylindrical shell 111 by a predetermined distance.

A refrigerant suction pipe 115 may be coupled through a side surface of the cylindrical shell 111. Accordingly, the refrigerant suction pipe 115 may be coupled through the cylindrical shell 111 forming the casing 110 in a radial direction.

An inner end of the refrigerant discharge pipe 116 may be coupled through an upper portion of the upper shell 112 to communicate with the inner space 110*a* of the casing 110, specifically, the upper space S2 defined above the driving motor 120.

The refrigerant discharge pipe 116 may be provided therein with an oil separator for separating oil from refrigerant discharged from the compressor 10 to a condenser 20, or a check valve for suppressing refrigerant discharged from the compressor 10 from flowing back into the compressor 10.

One end portion of an oil circulation pipe may be radially coupled through a lower end portion of the lower shell 113. Both ends of the oil circulation pipe may be open, and another end portion of the oil circulation pipe may be coupled through the refrigerant suction pipe 115. An oil circulation valve may be installed in a middle portion of the oil circulation pipe.

Referring to FIG. 1, the driving motor 120 according to the implementation may include a stator 121 and a rotor 122. The stator 121 may be fixed into the inner circumferential surface of the cylindrical shell 111, and the rotor 122 may be rotatably disposed in the stator 121.

The stator 121 may include a stator core 1211 and a stator coil 1212.

The stator core 1211 may be formed in an annular shape or a hollow cylindrical shape and may be shrink-fitted onto the inner circumferential surface of the cylindrical shell 111.

The stator coil 1212 may be wound around the stator core 1211 and may be electrically connected to an external power source through a power cable 1141 that is coupled through the casing 110. An insulator (no reference numeral), which is an insulating member, may be inserted between the stator core 1211 and the stator coil 1212.

The rotor 122 may include a rotor core 1221 and permanent magnets 1222.

The rotor core 1221 may be formed in a cylindrical shape to be accommodated in a rotor accommodating portion 1211*a* defined in a central portion of the stator core 1211.

Specifically, the rotor core 1221 may be rotatably inserted into the rotor accommodating portion 1211*a* of the stator core 1211 with a predetermined gap (no reference numeral) therebetween. The permanent magnets 1222 may be embedded in the rotor core 1221 at preset intervals along the circumferential direction.

A balance weight 123 may be coupled to a lower end of the rotor core 1221. Alternatively, the balance weight 123 may be coupled to the rotating shaft 125. This implementation will be described based on an example in which the balance weight 123 is coupled to the rotating shaft 125. The balance weight 123 may be disposed on each of a lower end side and an upper end side of the rotor, and the two balance weights 123 may be installed symmetrically to each other.

The rotating shaft 125 may be coupled to the center of the stator core 1211. An upper end portion of the rotating shaft 125 may be press-fitted to the rotor 122, and a lower end portion of the rotating shaft 125 may be rotatably inserted into the main frame 130 to be supported in the radial direction.

The main frame 130 may be provided with a main bearing 171 configured as a bush bearing to support the lower end portion of the rotating shaft 125. Accordingly, a portion, which is inserted into the main frame 130, of the lower end portion of the rotating shaft 125 may smoothly rotate inside the main frame 130.

The rotating shaft 125 may transfer a rotational force of the driving motor 120 to an orbiting scroll 150 constituting the compression part C. Accordingly, the orbiting scroll 150 eccentrically coupled to the rotating shaft 125 may perform an orbiting motion with respect to the fixed scroll 140.

An oil supply passage 126 having a hollow shape is provided in the rotating shaft 125, and an oil pickup 127 configured to pump oil filled in the oil storage space S11 may be coupled to a lower end of the rotating shaft 125. Accordingly, during rotation of the rotating shaft 125, the oil filled in the oil storage space S11 is sucked into an upper end of the rotating shaft 125 through the oil pickup 127 and the oil supply passage 126 to lubricate a sliding unit.

Referring to FIG. 1, the compression unit C according to this implementation includes the main frame 130, the fixed scroll 140, and the orbiting scroll 150.

The main frame 130 may include a frame end plate 131, a frame side wall 132, and a main bearing portion 133. The frame end plate 131 is installed below the driving motor 120. A main bearing hole 1331 constituting the main bearing portion 133 to be described later may be formed through a center portion of the frame end plate 131 in an axial direction. The frame side wall 132 may extend in a cylindrical shape from an edge of a lower side surface of the frame end plate 131, and be fixed to the inner circumferential surface of the cylindrical shell 111 by performing shrink-fitting or welding. The main bearing portion 133 includes a main bearing hole 1331 through which the rotating shaft 125 is rotatably inserted to support the rotating shaft 125 in the radial direction.

The fixed scroll 140 includes a fixed end plate 141, a fixed side wall 142, a sub bearing portion 143, and a fixed wrap 144.

The fixed end plate 141 is provided in a disk shape and arranged below the frame end plate 131 with a preset space therebetween. A sub bearing hole 1431 constituting the sub bearing unit 143 is formed through a center portion of the frame end plate 141 in a longitudinal direction. A first discharge port 1411 and a second discharge port 1412 are provided around the sub bearing hole 1431. The first and second discharge ports 1411 and 1412 communicate with a first compression chamber V1 and a second compression chamber V2, respectively, such that compressed refrigerant is discharged into a muffler space 160*a* of the discharge cover 160.

The first discharge port 1411 and the second discharge port 1412 are provided in a position eccentric from a center of the fixed end plate 141. In other words, as the sub bearing hole 1431 is provided through the center of the fixed end plate 141, the first discharge port 1411 and the second discharge port 1412 are arranged in positions eccentric from the sub bearing hole 1431. The first discharge port 1411 and the second discharge port 1412 will be described later, together with a refrigerant accommodating groove 1444.

The fixed side wall 142 extends from an edge of an upper surface of the fixed end plate 141 in a longitudinal direction to be coupled to the frame side wall 132 of the main frame 130. The fixed side wall 142 may be provided with a suction port 1421 formed through the fixed side wall 142 in the radial direction. As aforementioned, an end portion of the refrigerant suction pipe 115 inserted through the cylindrical shell 111 may be inserted into the suction port 1421.

The sub bearing hole 1431 having a cylindrical shape may be formed through a center of the sub bearing portion 143 in the axial direction to radially support a lower end of the rotating shaft 125.

The fixed wrap 144 is provided to extend from the upper surface of the fixed end plate 141 toward the orbiting scroll 150 in the axial direction. The fixed wrap 144 may be engaged with an orbiting wrap 152 to be described later to define a compression chamber V. The compression chamber V includes the first compression chamber V1 defined between an inner surface of the fixed wrap 144 and an outer surface of the orbiting wrap 152, and the second compression chamber V2 defined between an outer surface of the fixed wrap 144 and an inner surface of the orbiting wrap 152.

The fixing wrap 144 may be formed in an involute shape. However, the fixed wrap 144 and the orbiting wrap 152 may be formed in various shapes other than the involute shape. For example, the fixed wrap 144 may be formed in an approximately elliptical shape in which a plurality of arcs having different diameters and origins are connected to each other and an outermost curve has a major axis and a minor axis. The orbiting wrap 152 may also be formed in a similar manner.

The orbiting scroll 150 includes an orbiting end plate 151, the orbiting wrap 152, and a rotating shaft coupling portion 153.

The orbiting end plate 151 is provided in a disk shape and accommodated between the frame end plate 131 and the fixed end plate 141. An upper surface of the orbiting end plate 151 may be supported in the axial direction by the main frame 130 with a back pressure sealing member (no reference numeral) interposed therebetween.

The orbiting wrap 152 extends from a lower surface of the orbiting end plate 151 toward the fixed end plate 141, and is engaged with the fixed wrap 144 to define the first pressure chamber V1 and the second pressure chamber V2, both described above.

Since the orbiting wrap 152 has a shape corresponding to the shape of the fixed wrap 144 described above, a description of the orbiting wrap 152 will be replaced with the description of the fixed wrap 144. However, an inner end portion of the orbiting wrap 152 is provided in a central portion of the orbiting end plate 151, and the rotating shaft coupling portion 153 may be inserted through the central portion of the orbiting end plate 151 in the axial direction. Accordingly, as described above, the first discharge port 1411 and the second discharge port 1412 are provided in positions eccentric from a center of the orbiting scroll 150, i.e., the rotating shaft coupling portion 153.

The rotating shaft 125 may be rotatably inserted and coupled into the rotating shaft coupling portion 153. An outer circumferential part of the rotating shaft coupling portion 153 is connected to the orbiting wrap 152 to define the first compression chamber V1 together with the fixed wrap 144 during a compression process.

The rotating shaft coupling portion 153 is provided at a height at which it overlaps the orbiting wrap 152 on the same plane. That is, the rotating shaft coupling portion 153 is disposed at a height at which an eccentric portion 1251 of the rotating shaft 125 overlaps the orbiting wrap 152 on the same plane. Accordingly, repulsive force and compressive force of refrigerant can cancel each other while being applied to the same plane based on the orbiting end plate 151, and thus inclination of the orbiting scroll 150 due to interaction between the compressive force and the repulsive force can be suppressed.

However, since the outer surface of the rotating shaft coupling portion 153 and the inner surface of the fixed wrap 144 define the first pressure chamber V1 as described above, it may be understood that the rotating shaft coupling portion 153 constitutes a part of the orbiting wrap 152. Thus, the rotating shaft coupling portion 153 may be referred to as the orbiting wrap 152 as needed. For example, a discharge guide groove 1524, a second refrigerant accommodating groove 1525, etc. to be described later are substantially provided in an end surface of the rotating shaft coupling portion 153. However, hereinafter, the discharge guide groove 1524 and the second refrigerant accommodating groove 1525 are described as being provided in an end surface of the orbiting wrap 152 at an innermost side.

In the drawing, unexplained reference numerals, i.e., 1413 denotes a bypass hole, and 170 denotes an Oldham ring.

The scroll compressor according to the implementation may operate as follows.

That is, when power is applied to the motor 120, rotational force may be generated and the rotor 122 and the rotating shaft 125 may rotate accordingly. As the rotating shaft 125 rotates, the orbiting scroll 150 eccentrically coupled to the rotating shaft 125 may perform an orbiting motion relative to the fixed scroll 140 by the Oldham ring 170.

Then, volumes of the first pressure chamber V1 and the second pressure chamber V2 gradually decrease in a direction from an outer portion toward a central portion of each of the first and second pressure chambers V1 and V2. Then, refrigerant is sucked into the first and second pressure chambers V1 and V2 through the refrigerant suction pipe 115.

Then, the refrigerant is compressed while moving along a movement trajectory of each of the first and second compression chambers V1 and V2. The compressed refrigerant is discharged into the muffler space 160*a* of the discharge cover 160 through the first and second discharge ports 1411 and 1412 communicating with the first and second compression chambers V1 and V2, respectively.

The refrigerant flows out into the outflow passage S12 between the main frame 130 and the driving motor 120 through outflow holes (no reference numeral) in the fixed scroll 140 and the main frame 130. Then, the refrigerant passes through the driving motor 120 to move to the upper space S2 of the casing 110 defined above the driving motor 120. The refrigerant is separated into refrigerant and oil in the upper space S2. The refrigerant, i.e., a result of the separation flows out of the casing 110 through the refrigerant discharge pipe 116, whereas the oil obtained by being separated from the refrigerant is returned to the oil storage space S11 of the casing 110 through the oil return passage (no reference numeral) described above. The oil is supplied to a bearing surface (no reference numeral) and the compression chamber V through the oil supply passage 126, and then returned. This series of processes may be repeatedly performed.

In a through-shaft scroll compressor as described above, as the rotating shaft 125 is inserted through the center of the fixed scroll 140, the first and second discharge holes 1411 and 1412 are arranged in a position eccentric from the center of the fixed scroll 140. Thus, as a compression cycle of the first pressure chamber V1 in an inner portion of the fixed wrap 144 is shorter than that of the second compression chamber V2 on an outer portion of the fixed wrap 144, a compression ratio in the first pressure chamber V1 may be reduced.

Thus, an increase portion 1521 in which a wrap curve is expanded may be provided on an outer circumferential surface of the orbiting wrap 152 at an innermost portion, i.e., an outer circumferential surface of the rotating shaft coupling portion 153 to extend a compression cycle of the first compression chamber V1. However, since a decrease portion 1441 is provided near a discharge end of the fixed wrap 144 corresponding to the increase portion 1521 of the orbiting wrap 152 to correspond to the increase portion 1521, a wrap thickness of the fixed wrap 144 is small near the discharge end under a comparatively high pressure. Thus, the fixed wrap 144 may not stand pressure in the compression chamber V and may be damaged. This may frequently occur particularly when liquid refrigerant or oil excessively flows into the compression chamber V.

In consideration of this, areas of the first and second discharge ports 1411 and 1412 may be enlarged. However, when the areas of the first and second discharge ports 1411 and 1412 are enlarged, a discharge start time of each of the first and second compression chambers V1 and V2 is advanced, thereby deteriorating a compression ratio. Accordingly, there is a limitation in ensuring a proper compression ratio by enlarging sizes of the first and second compression chambers V1 and V2.

In relation to this, in this implementation, excessive compression may be suppressed by expanding a volume of a compression chamber constituting discharge pressure. By doing so, compression efficiency may be increased, and even when refrigerant that was not compressed together with liquid refrigerant is introduced, a damage to the fixed wrap 144 may be suppressed, and thus, reliability may be increased.

Figure 3:
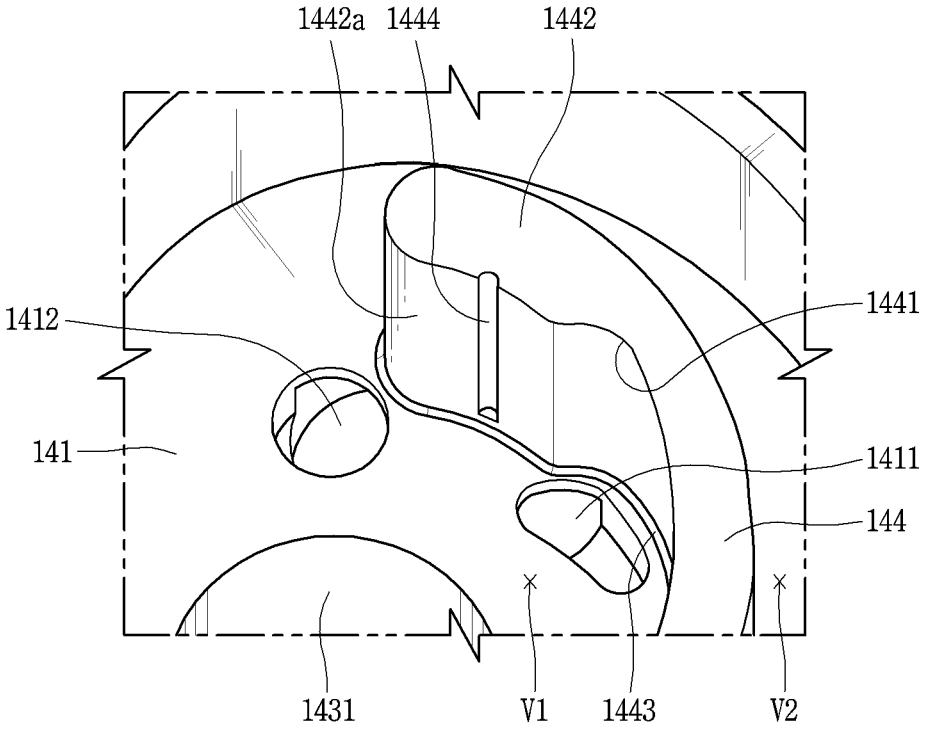
FIG. 3 is an enlarged perspective view of a main portion of the fixed scroll of FIG. 2.
Figure 4:
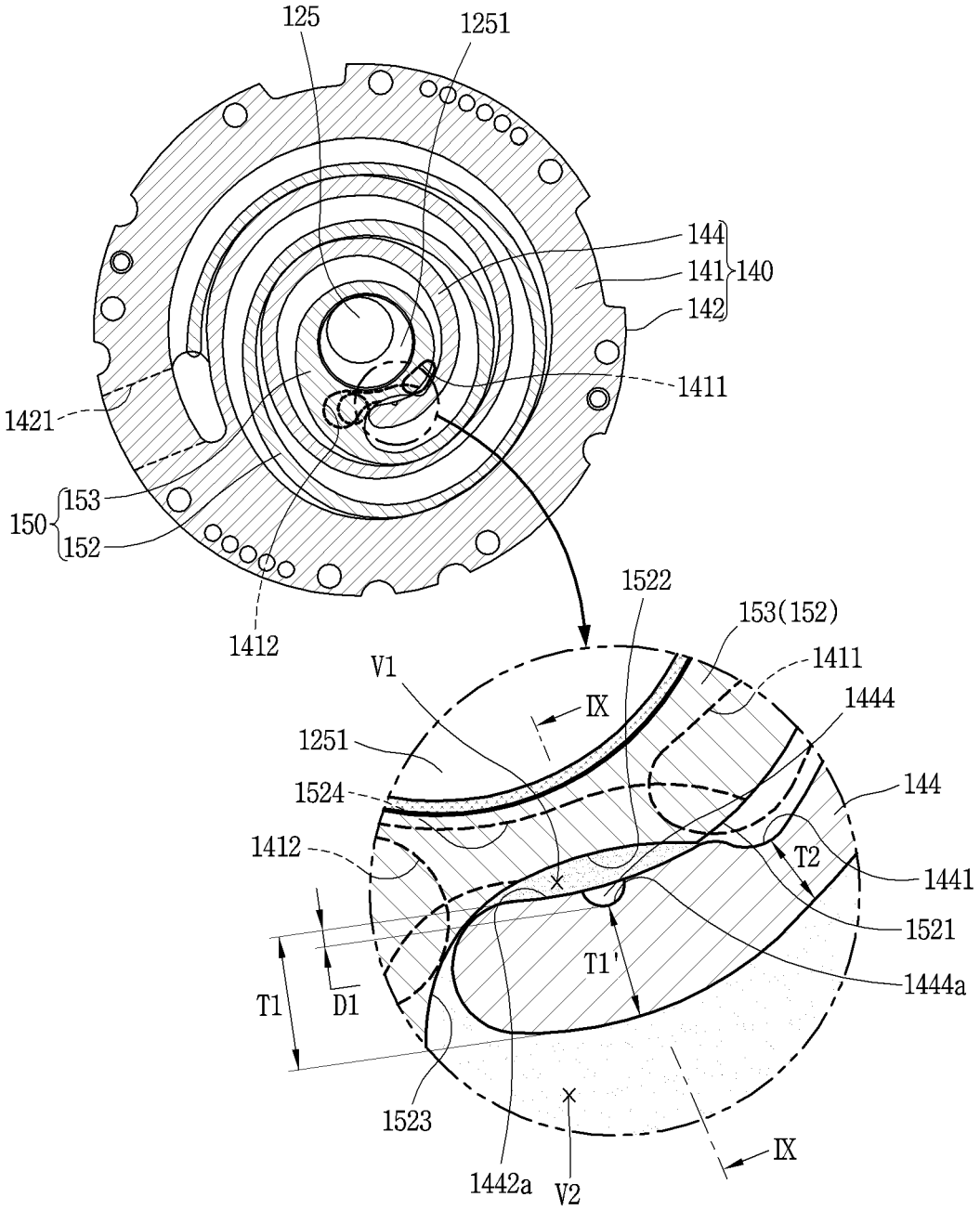
FIG. 4 is a cross-sectional view illustrating a state in which the fixed scroll is coupled to the orbiting scroll, both shown in FIG. 2.
Figure 5:
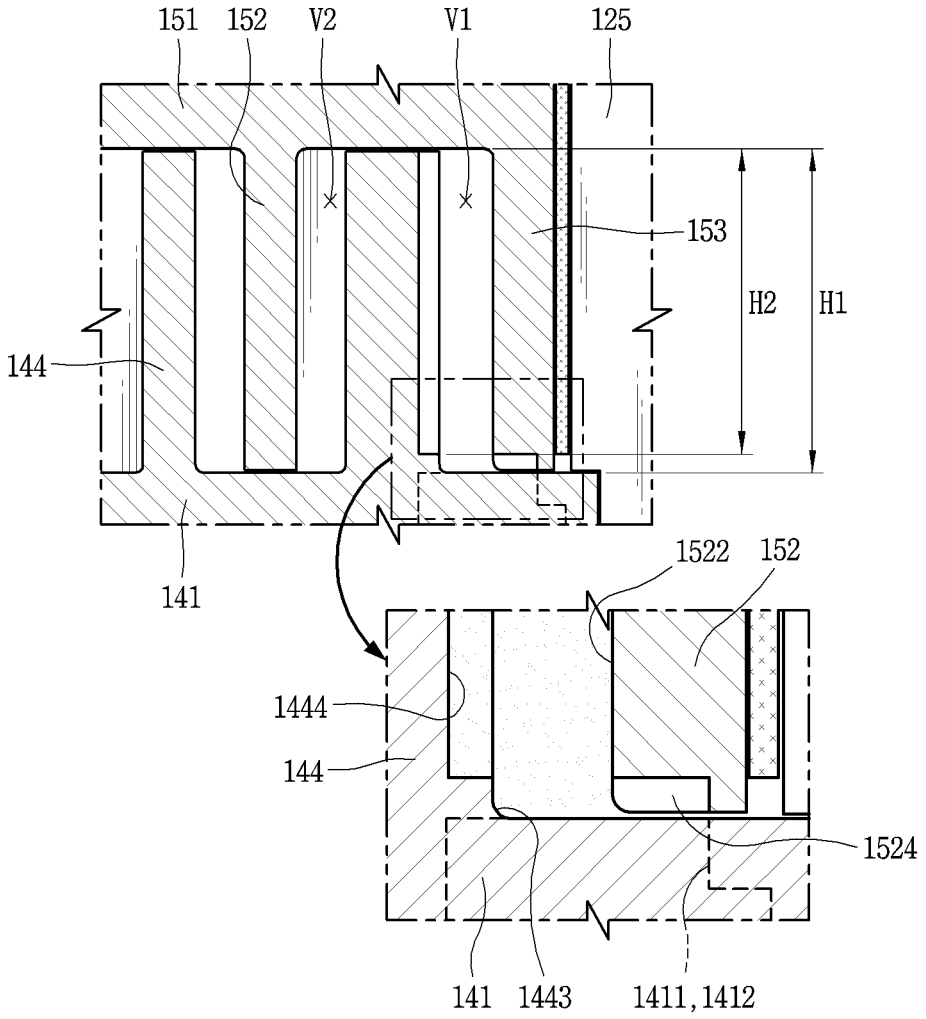
FIG. 5 is a cross-sectional view taken along line "IX-IX" of FIG. 4.

FIG. 2 is a detached perspective view of the fixed scroll and the orbiting scroll both shown in FIG. 1. FIG. 3 is an enlarged perspective view of a main portion of the fixed scroll of FIG. 2. FIG. 4 is a cross-sectional view illustrating a state in which the fixed scroll is coupled to the orbiting scroll, both shown in FIG. 2. FIG. 5 is a cross-sectional view taken along line "IX-IX" of FIG. 4.

Referring to FIGS. 2 to 5, the fixed scroll 140 and the orbiting scroll 150 according to this implementation are engaged with each other to define the first and second compression chambers V1 and V2. Areas of the first and second compression chambers V1 and V2 gradually decrease in a direction from an edge constituting a suction portion toward a center portion constituting a discharge portion. Accordingly, the first and second compression chambers V1 and V2 are provided such that pressure in a central portion is higher than that in an edge portion.

However, as the rotating shaft 125 is inserted and coupled through a central portion of the fixed scroll 140 and the orbiting scroll 150, the first discharge port 1411 and the second discharge port 1412 are arranged in positions eccentric from the center of the fixed scroll 140 as described above. Accordingly, as described above, a compression cycle of the first compression chamber V1 may be extended by providing the increase portion 1521 on an outer circumferential surface of the orbiting wrap 152 at an innermost portion (hereinafter referred to as an orbiting wrap). By doing so, a compression ratio of the first compression chamber V1 may be corrected to be similar to that of the second compression chamber V2.

In detail, referring to FIG. 2, the orbiting scroll 150 includes the orbiting wrap 152 provided on one side surface of the orbiting end plate 151 and the rotating shaft coupling portion 153 inserted through a center of the orbiting scroll 150. Like the fixed wrap 144, the orbiting wrap 152 may be provided such that a plurality of circular arcs having different diameters and origins are connected to each other so that wrap curves have atypical characteristics.

Accordingly, the orbiting wrap 152 may be provided to have different wrap thicknesses according to a wrap progressing direction.

For example, the orbiting wrap 152 includes the increase portion 1521 having a gradually increasing wrap thickness, at an end of a discharge portion (accurately, an outer circumferential surface of the rotating shaft coupling portion 153), and a concave portion 1522 having a decreasing wrap thickness to extend from the increase portion 1521 toward the discharge portion and connect to a circular arc portion 1523. The increase portion 1521 corresponds to the decrease portion 1441 of the fixed wrap 144 to be described later, and the concave portion 1522 corresponds to a projecting portion 1442 of the fixed wrap 144 to be described later.

Referring to FIG. 2, the fixed scroll 140 according to this implementation includes the fixed side wall 142 at an edge of the fixed end plate 141, the sub bearing unit 143 in a center portion of the fixed end plate 141, and the first discharge port 1411 and the second discharge port 1412 near the sub bearing unit 143 to have a preset space with each other. The first discharge port 1411 communicates with the first compression chamber V1, and the second discharge port 1412 communicates with the second compression chamber V2. Accordingly, refrigerant compressed while moving along the first compression chamber V1 is discharged into the muffler space 160*a* of the discharge cover 160 through the first discharge port 1411, and refrigerant compressed while moving along the second compression chamber V2 is discharged into the muffler space 160*a* of the discharge cover 160 through the second discharge port 1412.

The fixed wrap 144 constituting the first and second compression chamber V1 and V2 described above are provided in the fixed side wall 142. The fixed wrap 144 may be provided such that a plurality of circular arcs having different diameters and origins are connected to each other so that wrap curves have atypical characteristics. Accordingly, the fixed wrap 144 may be provided to have different wrap thicknesses according to a wrap progressing direction.

For example, the fixed wrap 144 includes the decrease portion 1441 at an end of a discharge portion to correspond to the increase portion 1521 of the orbiting wrap 152 as described above, and the projecting portion 1422 protruding from the decrease portion 1441 to correspond to the concave portion 1522 of the orbiting wrap 152 described above.

In other words, the fixed wrap 144 includes the decrease portion 1441 having a wrap thickness gradually decreasing toward a discharge end to correspond to the increase portion 1521 of the orbiting wrap 152, and the projecting portion 1442 extending toward a discharge portion of the decrease portion 1441 and having an increasing wrap thickness to correspond to the concave portion 1522 of the orbiting wrap 152. The projecting portion 1442 provides the discharge end of the fixed wrap 144. Thus, a discharge chamber, i.e., a final compression chamber is provided in a periphery of the decrease portion 1441 including the projecting portion 1442 and a periphery of the increase portion 1521 including the concave portion 1522 of the orbiting wrap 152 facing the periphery of the decrease portion 1441.

Referring to FIGS. 3 to 5, the refrigerant accommodating groove 1444 is provided in a side surface of the fixed wrap 144 according to this implementation. The refrigerant accommodating groove 1444 is provided in an inner surface 144*a* of the fixed wrap 144 to be radially recessed to a preset depth. By doing so, as a volume of the first compression chamber V1, more accurately, a volume of the first compression chamber V1 in a discharge portion increases, excessive compression may be resolved. In other words, as refrigerant compressed in the first compression chamber V1 (e.g., liquid refrigerant) temporarily escapes into the refrigerant accommodating groove 1444, an excessive pressure increases in the first compression chamber V1 may be avoided, and thus, a damage to a discharge end portion of the fixed wrap 144 may be suppressed.

For example, the refrigerant accommodating groove 1444 may be provided in an inner surface of the fixed wrap 144 constituting a compression chamber (a discharge chamber) provided at a time when the first and second discharge ports 1411 and 1412 start discharging. In other words, the refrigerant accommodating groove 1444 may be provided in the inner surface of the fixed wrap 144 facing the first discharge port 1411 and the second discharge port 1412 to, when being axially projected, be located between the first discharge port 1411 and the second discharge port 1412. Accordingly, the refrigerant accommodating groove 1444 is located at a side behind the first discharge port 1411 and/or the second discharge port 1412 with reference to a compression path of the refrigerant. Then, the refrigerant compressed in the compression chamber V may be prevented from remaining in the compression chamber V after passing through the first discharge port 1411 and/or the second discharge port 1412.

In addition, as the refrigerant accommodating groove 1444, when being axially projected, is located between the first and second discharge ports 1411 and 1412, i.e., in the compression chamber V corresponding to a discharge portion, a volume of the compression chamber V constituting the discharge portion (e.g., the first compression chamber V1) increases in correspondence with a volume of the refrigerant accommodating groove 1444. Thus, excessive compression may be resolved. In addition, as a free space into which liquid refrigerant may escape is provided in the compression chamber V constituting the discharge portion in correspondence with the volume of the refrigerant accommodating groove 1444 (e.g., the first compression chamber V1), stress on the fixed wrap 144 may be resolved.

In detail, the refrigerant accommodating groove 1444 may be provided in an inner surface 1442*a* of the projecting portion 1442. In other words, the refrigerant accommodating groove 1444 may be provided in the inner surface 1442*a* of the projecting portion 1442 located between the first discharge port 1411 and the second discharge port 1412. By doing so, a volume of a compression chamber (a discharge chamber) in a section in which a compression load on the fixed wrap 144 is greatest may increase. Thus, as described above, excessive compression may be resolved, and simultaneously, a damage to the fixed wrap 144 due to the excessive compression may be suppressed.

Referring to FIG. 4, the refrigerant accommodating groove 1444 is recessed from the inner surface 1442*a* to an outer surface 1442*b* of the projecting portion 1442. A recessed depth D1 of the refrigerant accommodating groove 1444 may be provided to be less than half of a wrap thickness T (an average wrap thickness) of the projecting portion 1442. For example, the recessed depth D1 of the refrigerant accommodating groove 1444 may be provided such that a minimum wrap thickness T1' of the projecting portion 1442 is equal to or greater than a wrap thickness T2 of the decrease portion 1441, the minimum wrap thickness T1' of the projecting portion 1442 being defined as a minimum distance from the inner surface 1444*a* of the refrigerant accommodating groove 1444 to the outer surface 1442*b* of the projecting portion 1442. By doing so, an excessive decrease in the minimum wrap thickness T1' of the projecting portion 1442 of the refrigerant accommodating groove 1444 may be suppressed. Thus, the projecting portion 1442 may be prevented from being damaged due to the refrigerant accommodating groove 1444.

The refrigerant accommodating groove 1444 is provided to have a shape of a semicircular cross-section when being axially projected, but is not limited thereto. In other words, the refrigerant accommodating groove 1444 may be provided to have a shape of an angular cross-section.

The refrigerant accommodating groove 1444 is provided to have a same cross-sectional area in an axial direction, but is not limited thereto. In other words, the refrigerant accommodating groove 1444 may be provided to have different cross-sectional areas along an axial direction. For example, the refrigerant accommodating groove 1444 may be provided to have a large cross-sectional area when being adjacent to the first discharge port 1411. Accordingly, refrigerant accommodated in the refrigerant accommodating groove 1444 may be guided to the first and second discharge ports 1411 and 1412.

The refrigerant accommodating groove 1444 is provided to have an axial length H2 greater than a radial depth. For example, the refrigerant accommodating groove 1444 is provided in an axial direction, and the axial length H2 of the refrigerant accommodating groove 1444 may be greater than the radial depth (accurately, a transverse depth) thereof. Accordingly, a volume of the refrigerant accommodating groove 1444 compared to the radial depth thereof may be ensured at maximum.

The refrigerant accommodating groove 1444 may be provided to be inclined or curved. Accordingly, when the refrigerant accommodating groove 1444 has a constant radial depth, a large volume may be ensured. This may be more effective when one refrigerant accommodating groove 1444 is provided.

Referring to FIG. 5, the axial length H2 of the refrigerant accommodating groove 1444 may be provided to be equal to or less than an axial height H1 of the fixed wrap 144. For example, the axial length H2 of the refrigerant accommodating groove 1444 may be provided to be less than the axial height H1 of the fixed wrap 144. In detail, the refrigerant accommodating groove 1444 may be provided from an end surface of the fixed wrap 144 toward the fixed end plate 141 along an axial direction, and an end of the refrigerant accommodating groove 1444 toward the fixed end plate 141, i.e., a second end may be provided not to overlap a built-up surface 1443 connected between the fixed wrap 144 and the fixed end plate 141 by a curve surface (or an inclined surface). In other words, the end toward the fixed end plate 141, i.e., a lower end of the refrigerant accommodating groove 1444 may be provided at a height same as or greater than that of the built-up surface 1443. Accordingly, a large volume of the refrigerant accommodating groove 1444 may be ensured, and rigidity of a lower end (a root portion) of the fixed wrap 144 may be ensured.

By doing so, occurrence of a compression loss may be suppressed by suppressing excessive compression in a discharge pressure section constituting a high-pressure region during operation of a compressor. In addition, a damage to the fixed wrap 144 due to the excessive compression in the discharge pressure section may be suppressed.

In addition, the refrigerant accommodating groove 1444 may be provided in the inner surface of the fixed wrap 144, and the refrigerant accommodating groove 1444 is provided such that an end of a root portion of the fixed wrap 144 is provided slightly apart from the fixed end plate 141. Thus, deterioration of rigidity of the fixed wrap 144 due to the refrigerant accommodating groove 1444 may be suppressed.

Hereinafter, a description will be given of another implementation of a refrigerant accommodating groove.

That is, in the implementations described above, one refrigerant accommodating groove is provided. However, in some cases, a plurality of refrigerant accommodating grooves may be provided.

Figure 6:
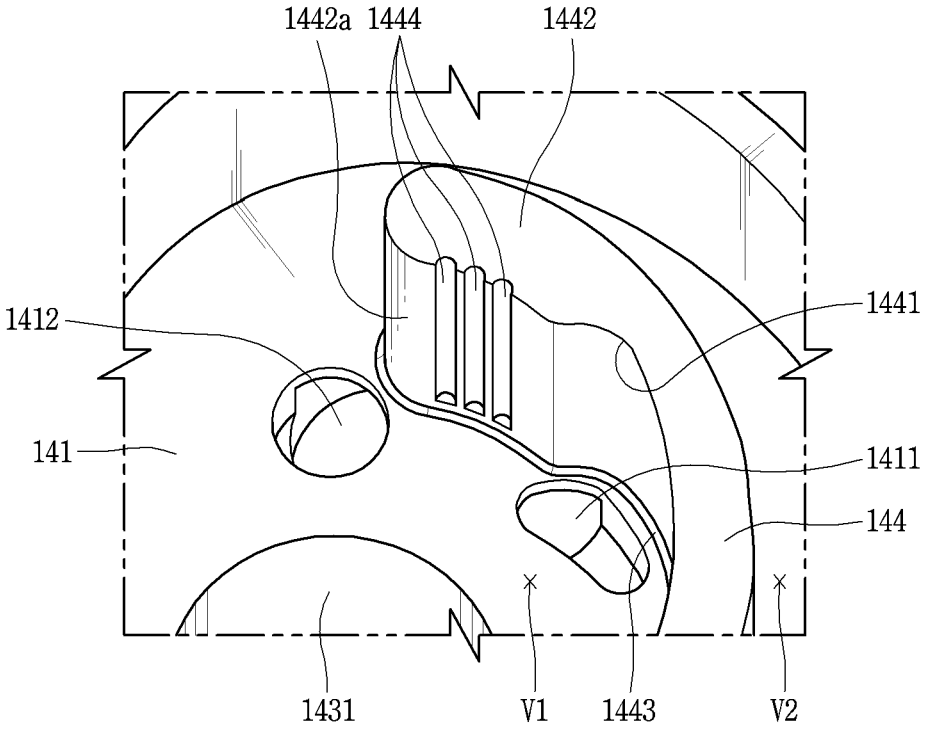
FIG. 6 is an enlarged perspective view of another implementation of the fixed scroll of FIG. 2.

FIG. 6 is an enlarged perspective view of another implementation of the fixed scroll 140 of FIG. 2.

Referring to FIG. 6, the fixed scroll 140 according to this implementation includes the fixed end plate 141, the fixed side wall 142, the sub bearing portion 143, and the fixed wrap 144. A basic configuration and an effect of the fixed end plate 141, the fixed side wall 142, the sub bearing portion 143, and the fixed wrap 144 are almost identical to those in the implementation described above. Thus, a description thereof will not be provided here.

In other words, in this implementation, an inner surface of the fixed wrap 144, i.e., the inner surface 1442*a* of the projecting portion 1442 is provided with the refrigerant accommodating groove 1444 like the implementation described above. In this case, a position, a shape, and an axial length of the refrigerant accommodating groove 1444 may be provided to be almost identical to those in the implementation described above.

However, in this implementation, a plurality of refrigerant accommodating grooves 1444 may be provided to have a preset space therebetween along a wrap providing direction of the fixed wrap 144. For example, the plurality of refrigerant accommodating grooves 1444 may be provided between the first discharge port 1411 and the second discharge port 1412 like the implementation described above, and provided to have a preset space therebetween along a wrap providing direction of the fixed wrap 144.

In detail, a radial depth (or a recessed depth) D1 of each of the refrigerant accommodating grooves 1444 may be provided to have a same or smaller size compared to that of the refrigerant accommodating groove 1444 in the implementation described above.

For example, when the radial depth D1 (or the recessed depth) of each of the refrigerant accommodating grooves 1444 is provided to be identical to that of the refrigerant accommodating groove 1444 in the implementation described above, a whole volume of the refrigerant accommodating grooves 1444 may increase correspondingly. Thus, excessive pressure in a high-pressure area constituting a discharge chamber section may be effectively resolved.

In addition, when the radial depth D1 (or the recessed depth) of each of the refrigerant accommodating groove 1444 is provided to be smaller than that of refrigerant accommodating groove 1444 in the implementation described above, a large cross-sectional area of the fixed wrap 144 (a projecting portion) other than the refrigerant accommodating grooves 1444 is ensured. Accordingly, the plurality of refrigerant accommodating grooves 1444 may be provided in the fixed wrap 144, and meanwhile, wrap rigidity in the high-pressure area constituting the discharge chamber section may be ensured.

When the plurality of refrigerant accommodating grooves 1444 are provided, specifications of the respective refrigerant accommodating grooves 1444, e.g., radial depths or axial lengths thereof may be provided variously. For example, the refrigerant accommodating grooves 1444 may have a radial depth or axial length gradually decreasing toward a discharge end. Accordingly, the plurality of refrigerant accommodating grooves 1444 may be provided in the fixed wrap 144, and meanwhile, rigidity of the fixed wrap 144 may be also ensured.

Hereinafter, a description will be given of still another implementation of a refrigerant accommodating groove.

That is, in the implementations described above, a refrigerant accommodating groove is provided only in a fixed wrap. However, in some cases, a refrigerant accommodating groove may be also provided in an orbiting wrap.

Figure 7:
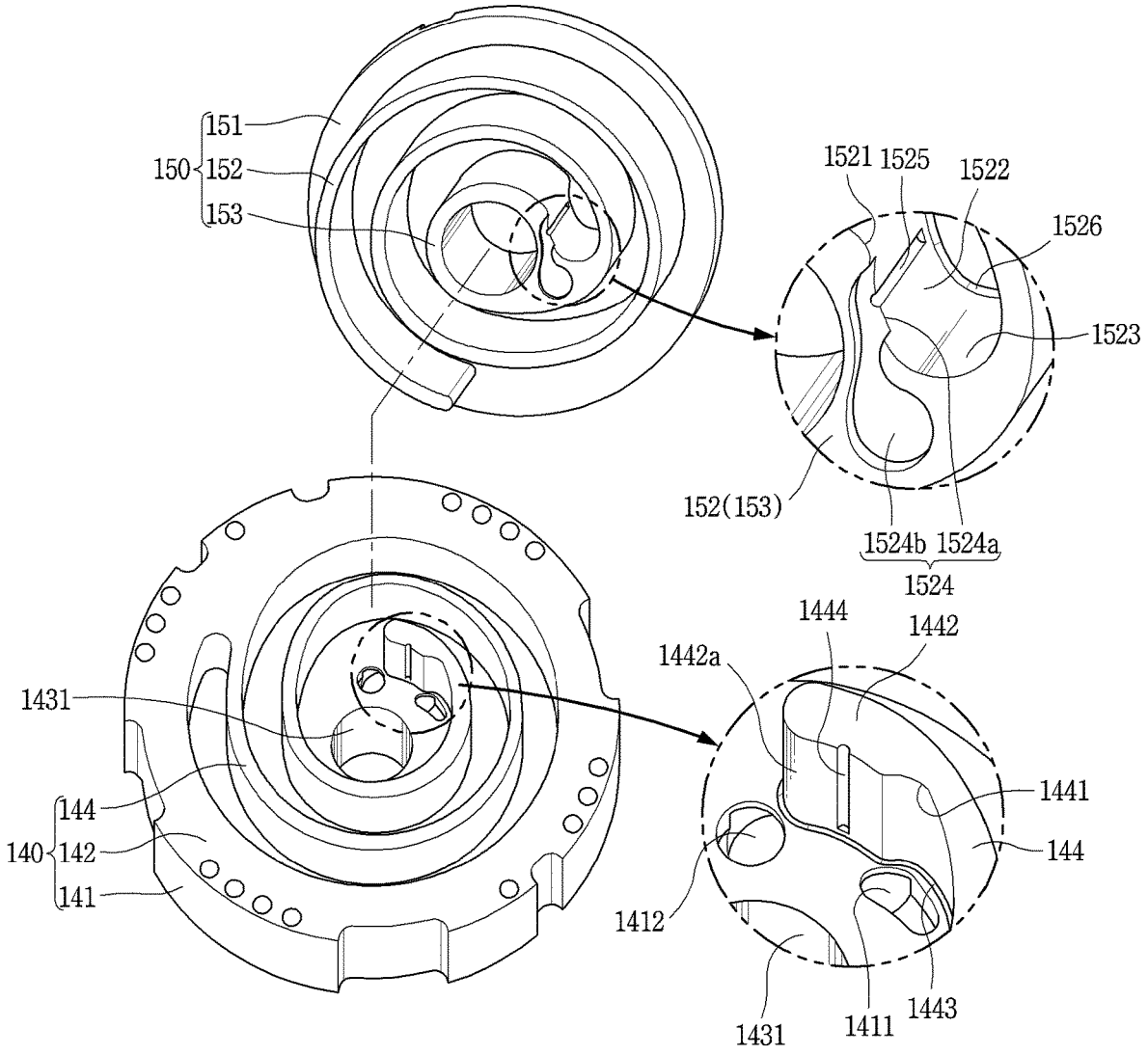
FIG. 7 is an enlarged perspective view of another implementation of a fixed scroll and an orbiting scroll.
Figure 8:
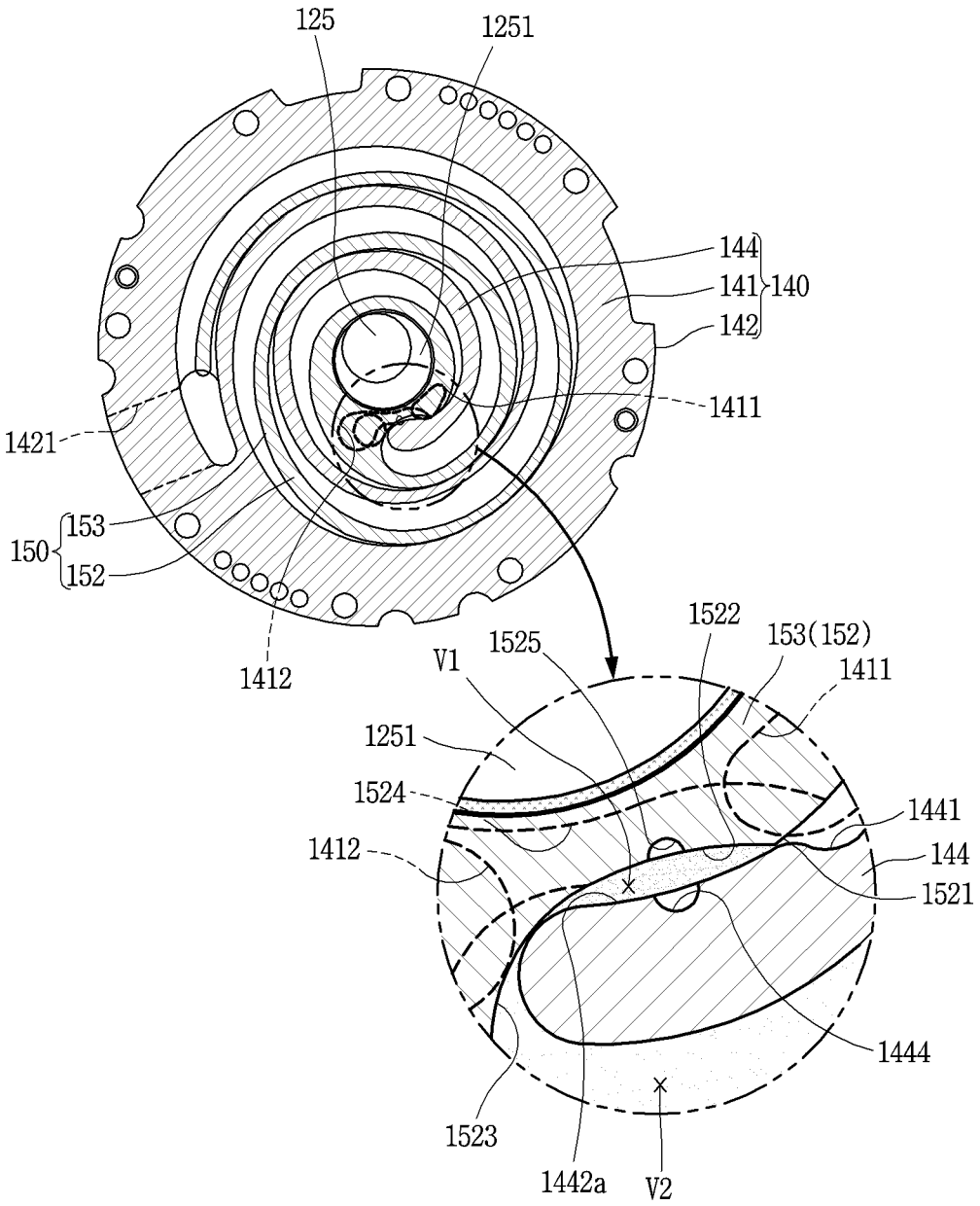
FIG. 8 is a cross-sectional view illustrating a state in which the fixed scroll is coupled to the orbiting scroll, both shown in FIG. 7.

FIG. 7 is an enlarged perspective view of another implementation of a fixed scroll and an orbiting scroll. FIG. 8 is a cross-sectional view illustrating a state in which the fixed scroll is coupled to the orbiting scroll, both shown in FIG. 7.

Referring to FIGS. 7 and 8, the fixed scroll 140 according to this implementation includes the fixed end plate 141, the fixed side wall 142, the sub bearing portion 143, and the fixed wrap 144. A basic configuration and an effect of the fixed end plate 141, the fixed side wall 142, the sub bearing portion 143, and the fixed wrap 144 are almost identical to those in the implementation described above. Thus, a description thereof will not be provided here again.

In other words, in this implementation, an inner surface of the fixed wrap 144, i.e., the inner surface 1442*a* of the projecting portion 1442 is provided with the refrigerant accommodating groove 1444 (hereinafter a first refrigerant accommodating groove) like the implementation described above. In this case, a position, a shape, and an axial length and an effect of the refrigerant accommodating groove 1444 are same as those of the refrigerant accommodating groove 1444 in the implementation described above. Thus, a description thereof will not be provided here again.

In addition, the orbiting scroll 150 includes the orbiting end plate 151, the orbiting wrap 152, and the rotating shaft coupling portion 153. A basic configuration and an effect of the orbiting end plate 151, the orbiting wrap 152, and the rotating shaft coupling portion 153 are almost identical to those in the implementation described above. Thus, a description thereof will not be provided here again.

In other words, in this implementation, as the rotating shaft coupling portion 153 is inserted through a center of the orbiting end plate 151, the increase portion 1521 and the concave portion 1522 are sequentially provided on an outer circumferential surface of the rotating shaft coupling portion 153 constituting a part of the orbiting wrap 152, the increase portion 1521 corresponding to the decrease portion 1551 of the fixed wrap 144 and the concave portion 1522 corresponding to the projecting portion 1442 of the fixed wrap 144. An effect obtained therefrom is identical to that in the implementations described above. Thus, a description thereof will not be provided here.

However, in this implementation, the second refrigerant accommodating groove 1525 is provided on an outer circumferential surface of the rotating shaft coupling portion 153, i.e., an outer surface of the orbiting wrap 152 facing an inner surface of the fixed wrap 144. For example, the second refrigerant accommodating groove 1525 may be included in a compression chamber including the first refrigerant accommodating groove 1444, in a section in which the compression chamber including the first refrigerant accommodating groove 1444 performs discharge strokes. In other words, in the same compression chamber, the first refrigerant accommodating groove 1444 may be provided in the fixed wrap 144, and the second refrigerant accommodating groove 1525 may be provided in the orbiting wrap 152. Accordingly, a compression chamber volume in a discharge chamber section corresponding to a high-pressure area may increase compared to the implementations described above. Thus, excessive compression in a compression chamber included in a discharge area may be suppressed to prevent a damage to the fixed wrap 144.

In addition, the second refrigerant accommodating groove 1525 may be provided to be identical to the first refrigerant accommodating groove 1444 in the implementations described above. For example, the second refrigerant accommodating groove 1525 may be provided to have a long groove shape such that an axial length (no reference numeral) is greater than a radial depth (no reference numeral), and greater than half of an axial length of the orbiting wrap 152 and less than the axial length of the orbiting wrap 152. In other words, the second refrigerant accommodating groove 1525 may be provided such that an end toward the orbiting end plate is located at a height equal to or less than that of the built-up surface 1526 connecting between the orbiting wrap 152 and the orbiting end plate 151 using a curved surface. Accordingly, the second refrigerant accommodating groove 1525 may be provided in the orbiting wrap 152, and rigidity of the orbiting wrap 152 may be ensured.

In addition, like FIGS. 7 and 8, the discharge guide groove 1524 may be further provided in an end surface of the rotating shaft coupling portion 153. In other words, an inlet 1524*a* of the discharge guide groove 1524 may be recessively provided at an outer edge of the orbiting wrap 152 at an innermost side constituting an outer edge of the rotating shaft coupling portion 153. In addition, an outlet 1524*b* of the discharge guide groove 1524 may be recessively provided in an end surface of the orbiting wrap 152 at an innermost side (the rotating shaft coupling portion) to extend from the outer edge of the orbiting wrap 152 at the innermost side along a circumferential direction.

In this case, the second refrigerant accommodating groove 1525 is provided to communicate with the discharge guide groove 1524. In other words, an end of the second refrigerant accommodating groove 1525 orienting toward the end surface of the second refrigerant accommodating groove 1525 at the innermost side may be provided to communicate with the inlet 1524*a* of the discharge guide groove 1524. Accordingly, after refrigerant accommodated in the second refrigerant accommodating groove 1525 is quickly guided to the discharge guide groove 1524, the refrigerant flows out into the first discharge port 1411 and/or the second discharge port 1412. Thus, as refrigerant (liquid refrigerant) in a compression chamber quickly flows out, remaining of the refrigerant in the compression chamber may be minimized to suppress excessive compression.

The second refrigerant accommodating groove 1525 is provided only in the orbiting wrap 152, and the first refrigerant accommodating groove 1444 (or the refrigerant accommodating groove) described above may not be provided in the fixed wrap 144. In this case, a configuration and an effect of the second refrigerant accommodating groove 1525 provided in the orbiting wrap 152 are identical to those of the second refrigerant accommodating groove 1525 described above. Thus, a description thereof will not be provided here.

Hereinafter, a description will be given of another implementation of a fixed scroll.

That is, in the implementation described above, a refrigerant accommodating groove is provided in an inner surface of a fixed wrap. However, in this implementation, an auxiliary discharge port may be further provided in a fixed end plate.

Figure 9:
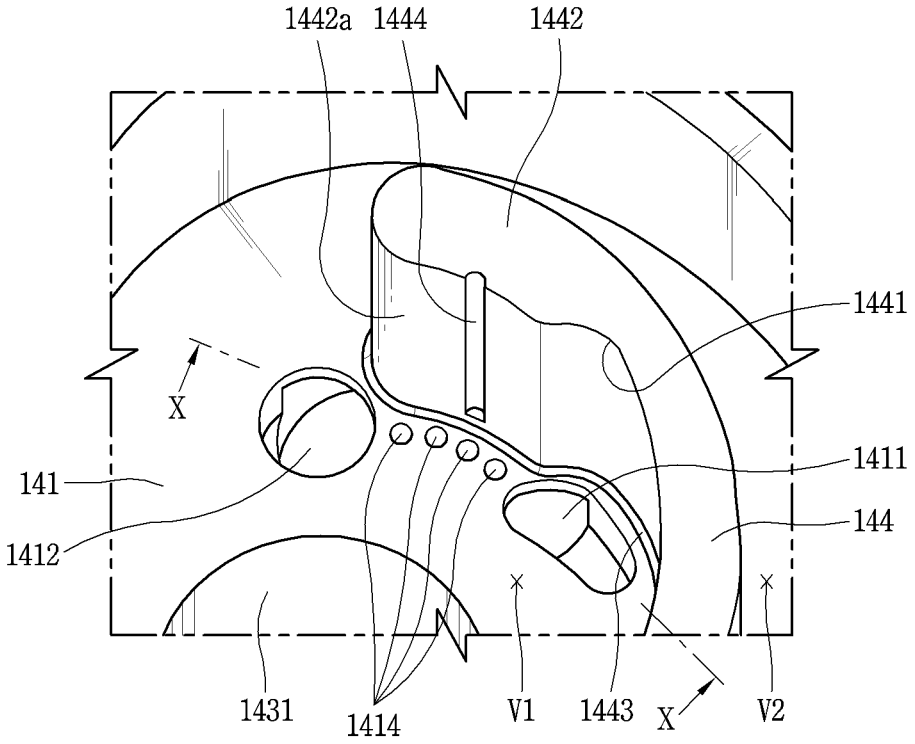
FIG. 9 is an enlarged perspective view of still another implementation of the fixed scroll of FIG. 2.
Figure 10:
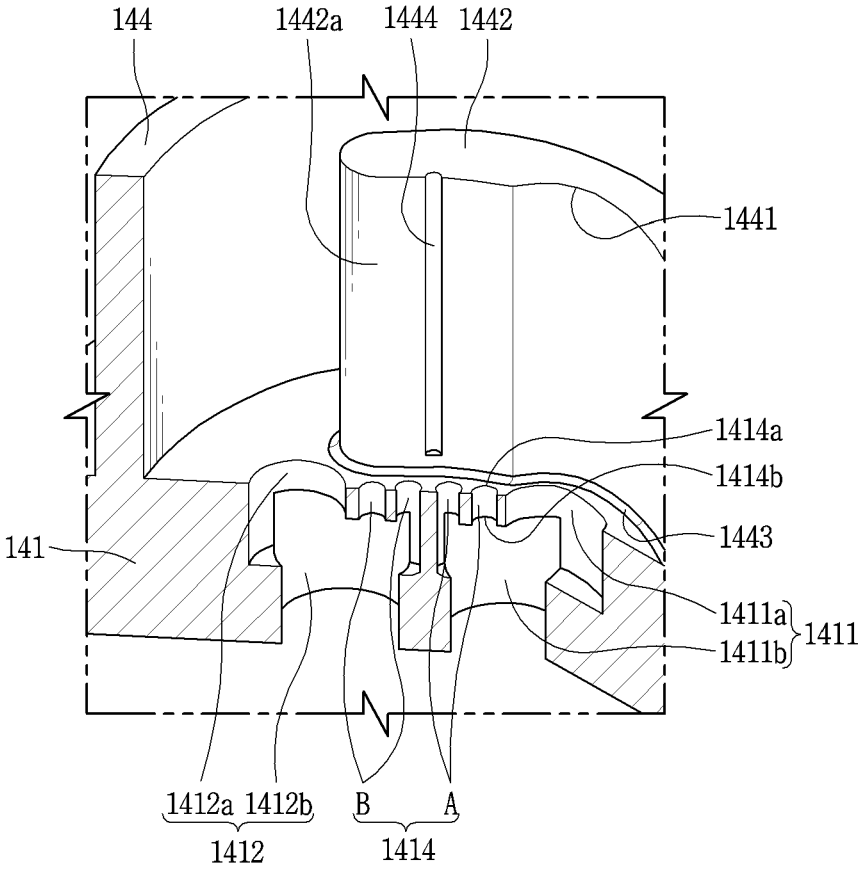
FIG. 10 is a cross-sectional view taken along line "X-X" of FIG. 9.
Figure 11:
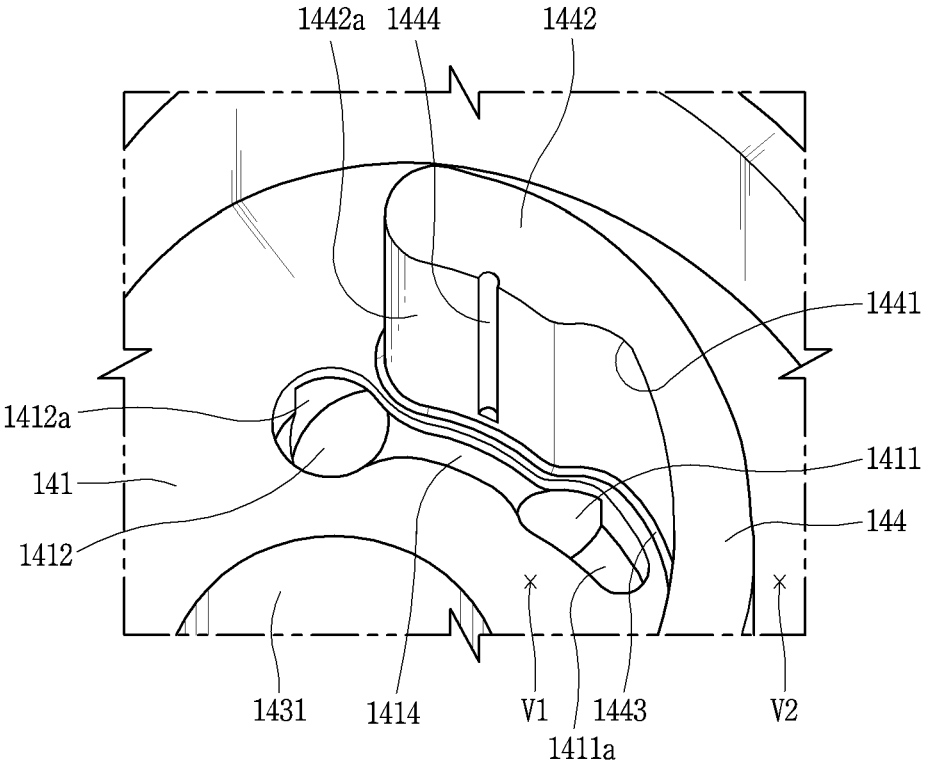
FIG. 11 is an enlarged perspective view of still another implementation of the fixed scroll of FIG. 2.

FIG. 9 is an enlarged perspective view of still another implementation of the fixed scroll of FIG. 2. FIG. 10 is a cross-sectional view taken along line "X-X" of FIG. 9. FIG. 11 is an enlarged perspective view of still another implementation of the fixed scroll of FIG. 2.

Referring to FIGS. 9 and 10, the fixed scroll 140 according to this implementation includes the fixed end plate 141, the fixed side wall 142, the sub bearing portion 143, and the fixed wrap 144. A basic configuration and an effect of the fixed end plate 141, the fixed side wall 142, the sub bearing portion 143, and the fixed wrap 144 are almost identical to those in the implementation described above. Thus, a description thereof will not be provided here.

In other words, in this implementation, an inner surface of the fixed wrap 144, i.e., the inner surface 1442*a* of the projecting portion 1442 is provided with the refrigerant accommodating groove 1444 like the implementation described above. In this case, a position, a shape, and an axial length of the refrigerant accommodating groove 1444 may be provided to be almost identical to those in the implementation described above.

However, the fixed end plate 141 according to this implementation may be provided with the first discharge port 1411 communicating with the first compression chamber V1 and the second discharge port 1412 communicating with the second compression chamber V2. The auxiliary discharge port 1414 may be arranged between the first discharge port 1411 and the second discharge port 1412. Accordingly, the auxiliary discharge port 1414 is located adjacent to the refrigerant accommodating groove 1444 compared to the first discharge port 1411 and/or the second discharge port 1412. Thus, refrigerant (liquid refrigerant) that escaped into the refrigerant accommodating groove 1444 during discharge strokes may quickly flow out through the auxiliary discharge port 1414 adjacent thereto. Also, as a discharge area (accurately, a discharge port inlet area) in a discharge pressure section constituting a high-pressure area is enlarged, excessive compression due to discharge resistance may be resolved.

In addition, as illustrated in FIG. 10, the auxiliary discharge port 1414 may communicate with the first discharge port 1411 and/or the second discharge port 1412. For example, the first discharge port 1411 and/or the second discharge port 1412 are provided to have a multi-stage shape in which outlets 1411*b* and 1412*b* are wider than inlets 1411*a* and 1412*a*. Thus, the inlet 1414*a* of the auxiliary discharge port 1414 is spaced apart from the inlets 1411*a* and/or 1412*a* of the first discharge port 1411 and/or the second discharge port 1412, but the outlet 1414*b* of the auxiliary discharge port 1414 may communicate with each of the outlets 1411*b* and/or 1412*b* of the first discharge port 1411 and/or the second discharge port 1412. Accordingly, refrigerant discharged through the auxiliary discharge port 1414 may quickly flow out into the muffler space 160*a* of the discharge cover 160 through the first discharge port 1411 and/or the second discharge port 1412.

In addition, at least one auxiliary discharge port 1414 may be provided between the first discharge port 1411 and the second discharge port 1412, and a plurality of auxiliary discharge ports 1414 may be provided as possible. Accordingly, a discharge area of a compression chamber may be enlarged.

In addition, the at least one auxiliary discharge port 1414 may be provided to have a smaller cross-sectional area than that of the first discharge port 1411 and/or the second discharge port 1412, and the plurality of auxiliary discharge ports 1414 may be provided to have a preset space therebetween. In other words, one auxiliary discharge port 1414 may be provided to be elongated. However, as illustrated in FIG. 6, the auxiliary discharge port 1414 may be divided into a plurality of auxiliary discharge ports to have a preset space therebetween. Like this implementation, when the plurality of auxiliary discharge ports 1414 are provided, rigidity of the fixed wrap 144 may be ensured compared to when one auxiliary discharge port 1414 is provided to be elongated.

For example, the auxiliary discharge ports 1414 may be provided to have a same space with each other between the first discharge port 1411 and the second discharge port 1412, and the auxiliary discharge ports 1414 may be provided to communicate with the first discharge port 1411 and the second discharge port 1412 in equal numbers or with a same cross-sectional area, respectively. In other words, among the auxiliary discharge ports 1414, an auxiliary discharge port A adjacent to the first discharge port 1411 may communicate with the first discharge port 1411, and an auxiliary discharge port B adjacent to the second discharge port 1412 may communicate with the second discharge port 1412. By doing so, discharge resistance in the first discharge port 1411 and the second discharge port 1412 may not be eccentrically but evenly distributed. Thus, the auxiliary discharge ports 1414 may be provided between the first discharge port 1411 and the second discharge port 1412, and a delay in refrigerant discharge may be minimized.

In addition, the plurality of auxiliary discharge ports 1414 may be provided to be spaced apart from the refrigerant accommodating groove 1444. In other words, as an end (a second end) of the refrigerant accommodating groove 1444 toward a wrap root thereof is provided at a height same as or greater than that of an end of a wrap portion of the built-up surface 1443, the auxiliary discharge ports 1414 may be spaced apart from the second end of the refrigerant accommodating groove 1444. Accordingly, the auxiliary discharge ports 1414 may be inserted through the fixed end plate 141, and meanwhile, rigidity of a root end of the fixed wrap 144 may be ensured.

As described above, when the auxiliary discharge ports 1414 are provided in the fixed end plate 141, refrigerant (liquid refrigerant) that escaped into the refrigerant accommodating groove 1444 in an inner surface of the fixed wrap 144 may quickly flow out through the auxiliary discharge ports 1414 located nearer than the first discharge port 1411 and/or the second discharge port 1412. By doing so, accumulation of non-discharged refrigerant in a discharge chamber section, i.e., a high-pressure area may be reduced to effectively resolve excessive compression. Particularly, when liquid refrigerant is accommodated in the refrigerant accommodating groove 1444, as the liquid refrigerant quickly flows out through the auxiliary discharge ports 1414. the excessive compression described above may be more effectively resolved.

In addition, as the fixed end plate 141 is further provided with the auxiliary discharge ports 1414 in addition to the first discharge port 1411 and the second discharge port 1412, an inlet area for discharge may be enlarged. Thus, as refrigerant in the discharge section. i.e., a high-pressure area is smoothly discharged, excessive pressure due to discharge resistance may be effectively resolved.

One auxiliary discharge port 1414 may be provided to a long groove shape. In this case, the auxiliary discharge port 1414 may be provided between the first discharge port 1411 and the second discharge port 1412, and spaced apart from the first discharge port 1411 and the second discharge port 1412.

In addition, as illustrated in FIG. 11, the auxiliary discharge port 1414 may be provided to communicate between the first discharge port 1411 and the second discharge port 1412. This case may be similar to a case when the inlet 1411*a* of the first discharge port 1411 and the inlet 1412*a* of the second discharge port 1412 may be connected to each other to substantially provide one discharge port. Accordingly, as discharge start times in the first and second compression chambers V1 and V2 match with each other, excessive compression due to a discharge delay may be resolved.

As described above, even when one auxiliary discharge port 1414 is provided to have a long groove shape, the refrigerant accommodating groove 1444 may be, when being radially projected, provided in a position radially overlapping the auxiliary discharge port 1414. Accordingly, refrigerant accommodated in the refrigerant accommodating groove 1444 may quickly move to the auxiliary discharge port 1414 and be discharged through the first discharge port 1411 and/or the second discharge port 1412.

The fixed end plate 141 may be provided with the auxiliary discharge port 1414 according to the implementations of FIGS. 9 and 11 described above, the fixed wrap 144 may be provided with the first refrigerant accommodating groove 1444 described above, and the orbiting wrap 152 may be provided with the second refrigerant accommodating groove 1525. In this case, the auxiliary discharge port 1414 and the first refrigerant accommodating groove 1444 may be provided to be identical to those in the implementations of FIGS. 9 and 11 described above, and the second refrigerant accommodating groove 1525 may be provided to be identical to that in the implementation of FIG. 7. An effect to be obtained therefrom may be similar to that in the implementation described above. However, in this implementation, as the second refrigerant accommodating groove 1525 is provided in the orbiting wrap 152, a discharge area of a compression chamber is enlarged like the implementation of FIG. 7. Thus, an area into which refrigerant (liquid refrigerant) may escape from the compression chamber may be enlarged, and excessive compression in the compression chamber may be effectively suppressed.

The fixed end plate 141 may be provided with the auxiliary discharge port 1414 according to the implementations of FIGS. 9 and 11 described above, and the orbiting wrap 152 may be provided with the second refrigerant accommodating groove 1525 described above. However, in this case, the fixed wrap 144 may not be provided with the first refrigerant accommodating groove 1444 described above. In this case, the auxiliary discharge port 1414 is provided to be identical to that in the implementations of FIGS. 9 and 11, and the second refrigerant accommodating groove 1525 may be provided to be identical to that in the implementation of FIG. 7. An effect resulting therefrom is similar to that of the implementations described above. Thus, a description thereof will not be provided here.

What is claimed is:

1. A scroll compressor comprising:

an orbiting scroll coupled to a rotating shaft and including an orbiting wrap, the orbiting wrap being disposed at an orbiting end plate and configured to orbit;

a fixed scroll including a fixed wrap disposed at a fixed end plate, the fixed wrap being configured to engage the orbiting wrap and define a compression chamber together with the orbiting wrap; and a refrigerant accommodating groove defined at at least one of (i) a side surface of the fixed wrap defining the compression chamber or (ii) a side surface of the orbiting wrap, wherein the compression chamber comprises a first compression chamber defined at an inner surface of the fixed wrap and a second compression chamber defined at an outer surface of the fixed wrap, wherein the fixed end plate defines a first discharge port configured to discharge refrigerant in the first compression chamber and a second discharge port configured to discharge refrigerant in the second compression chamber, and wherein the refrigerant accommodating groove is provided between the first discharge port and the second discharge port along a direction in which the fixed wrap extends.

2. The scroll compressor of claim 1, wherein an axial length of the refrigerant accommodating groove is longer than a radial depth of the refrigerant accommodating groove.

3. The scroll compressor of claim 1, wherein an axial length of the refrigerant accommodating groove is equal to or shorter than a wrap height of the fixed wrap or the orbiting wrap.

4. The scroll compressor of claim 3, wherein the axial length of the refrigerant accommodating groove is longer than half of the wrap height of the fixed wrap or the orbiting wrap and shorter than the wrap height of the fixed wrap or the orbiting wrap.

5. The scroll compressor of claim 1, wherein the refrigerant accommodating groove is spaced apart from the fixed end plate or the orbiting end plate by a preset height.

6. The scroll compressor of claim 1, wherein the fixed wrap comprises:

a decrease portion having a decreasing wrap thickness of the fixed wrap; and a projecting portion extending from the decrease portion and defining an end of the fixed wrap, the projecting portion having an increasing wrap thickness, wherein the refrigerant accommodating groove is provided at an inner surface of the projecting portion.

7. The scroll compressor of claim 6, wherein a radial depth of the refrigerant accommodating groove is shorter than half of a wrap thickness of the projecting portion.

8. The scroll compressor of claim 6, wherein a minimum distance from an inner surface of the refrigerant accommodating groove to an outer surface of the projecting portion is equal to or greater than a wrap thickness of the decrease portion.

9. The scroll compressor of claim 1, wherein the refrigerant accommodating groove includes a plurality of refrigerant accommodating grooves being spaced apart from each other along a direction in which the fixed wrap or the orbiting wrap extends.

10. The scroll compressor of claim 1, wherein the fixed end plate defines a discharge port configured to discharge refrigerant compressed in the compression chamber, and wherein the refrigerant accommodating groove is spaced apart from the discharge port.

11. The scroll compressor of claim 1, wherein the fixed end plate defines a discharge port configured to discharge refrigerant compressed in the compression chamber, and wherein the refrigerant accommodating groove is located at a side behind the discharge port along a compression progressing direction in the compression chamber.

12. The scroll compressor of claim 1, wherein the orbiting wrap includes a discharge guide groove connecting an outer surface defining the compression chamber to an end surface of the orbiting wrap, the end surface facing the fixed end plate, and wherein the discharge guide groove is in fluid communication with at least a part of the refrigerant accommodating groove at a discharge section of the compression chamber.

13. A scroll compressor comprising:

an orbiting scroll coupled to a rotating shaft and including an orbiting wrap, the orbiting wrap being disposed at an orbiting end plate and configured to orbit;

a fixed scroll including a fixed wrap disposed at a fixed end plate, the fixed wrap being configured to engage the orbiting wrap and define a compression chamber together with the orbiting wrap; and a refrigerant accommodating groove defined at at least one of (i) a side surface of the fixed wrap defining the compression chamber or (ii) a side surface of the orbiting wrap, wherein the compression chamber comprises a first compression chamber defined at an inner surface of the fixed wrap and a second compression chamber defined at an outer surface of the fixed wrap, wherein the fixed end plate defines a first discharge port configured to discharge refrigerant in the first compression chamber and a second discharge port configured to discharge refrigerant in the second compression chamber, and wherein an auxiliary discharge port is provided between the first discharge port and the second discharge port and inserted through the fixed end plate.

14. The scroll compressor of claim 13, wherein an inlet of the auxiliary discharge port is spaced apart from an inlet of the first discharge port and an inlet of the second discharge port, and wherein an outlet of the auxiliary discharge port is in fluid communication with at least one of an outlet of the first discharge port or an outlet of the second discharge port.

15. The scroll compressor of claim 13, wherein the auxiliary discharge port includes a plurality of auxiliary discharge ports being spaced apart from each other between the first discharge port and the second discharge port along a direction in which the fixed wrap extends.

16. The scroll compressor of claim 15, wherein inlets of the plurality of auxiliary discharge ports are spaced apart from the first discharge port and the second discharge port, wherein outlets of the plurality of auxiliary discharge ports are in fluid communication with the first discharge port and the second discharge port, and wherein a number of the outlets of the plurality of auxiliary discharge ports being in fluid communication with the first discharge port is equal to a number of the outlets of the plurality of auxiliary discharge ports being in fluid communication with the second discharge port.

17. The scroll compressor of claim 13, wherein the refrigerant accommodating groove is spaced apart from the auxiliary discharge port.

18. A scroll compressor comprising:

a casing;

a main frame disposed at the casing;

a rotating shaft;

a motor coupled to the rotating shaft;

an orbiting scroll coupled to the rotating shaft and including an orbiting wrap, the orbiting wrap being disposed at an orbiting end plate;

a fixed scroll including a fixed wrap disposed at a fixed end plate, the fixed wrap being configured to engage the orbiting wrap and define a compression chamber together with the orbiting wrap; and a refrigerant accommodating groove defined at at least one of a side surface of the fixed wrap or a side surface of the orbiting wrap, wherein the compression chamber comprises a first compression chamber defined at an inner surface of the fixed wrap and a second compression chamber defined at an outer surface of the fixed wrap, wherein the fixed end plate defines a first discharge port configured to discharge refrigerant in the first compression chamber and a second discharge port configured to discharge refrigerant in the second compression chamber, and wherein the refrigerant accommodating groove is provided between the first discharge port and the second discharge port along a direction in which the fixed wrap extends.

19. The scroll compressor of claim 18, wherein an axial length of the refrigerant accommodating groove is longer than a radial depth of the refrigerant accommodating groove.

* * * * *